US006832548B2

(12) United States Patent
Asai et al.

(10) Patent No.: US 6,832,548 B2
(45) Date of Patent: Dec. 21, 2004

(54) SHEET FEEDING DEVICE AND PRINTER INCLUDING THE SAME

(75) Inventors: Hideki Asai, Miyagi (JP); Takayuki Onodera, Miyagi (JP); Masayuki Abe, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 49 days.

(21) Appl. No.: 10/230,120

(22) Filed: Aug. 29, 2002

(65) Prior Publication Data

US 2003/0094107 A1 May 22, 2003

(30) Foreign Application Priority Data

Nov. 16, 2001 (JP) ..... 2001-351550

(51) Int. Cl.[7] ..... B41L 13/00
(52) U.S. Cl. ..... 101/118; 101/232
(58) Field of Search ..... 101/117, 118, 101/232; 271/10.09, 114, 227, 242, 265.01, 265.02, 270

(56) References Cited

U.S. PATENT DOCUMENTS 5,112,040 A * 5/1992 Johnston et al. ..... 271/11
5,342,037 A * 8/1994 Martin ..... 271/111
5,415,387 A * 5/1995 Suzuki ..... 271/10.02
5,927,703 A * 7/1999 Endo ..... 271/10.03
6,098,536 A * 8/2000 Ohkawa ..... 101/118
6,298,778 B1 10/2001 Onodera et al.

FOREIGN PATENT DOCUMENTS

JP 7-277553 10/1995
JP 8-169632 7/1996
JP 11314774 A * 11/1999 ..... B65H/3/06
JP 2000-132002 5/2000

* cited by examiner

*Primary Examiner*—Ren Yan
(74) *Attorney, Agent, or Firm*—Oblon, Spivak, McClelland, Maier & Neustadt, P.C.

(57) ABSTRACT

A sheet feeding device capable of again feeding, when failed to feed a sheet, the sheet by retry control is disclosed. The sheet feeding device includes a sheet tray loaded with a stack of sheets and a feed roller for sequentially feeding the sheets from the sheet tray one by one. A leading edge sensor is positioned downstream of the feed roller in the direction of sheet feed for sensing the leading edge of the sheet fed from the sheet tray. A registration roller pair is positioned downstream of the leading edge sensor in the direction of sheet feed for conveying the sheet toward an image transfer station at a preselected timing. When the retry control is to be executed, control means varies the content of control in accordance with information output from the leading edge sensor.

20 Claims, 10 Drawing Sheets

SHEET FEEDING DEVICE AND PRINTER INCLUDING THE SAME

BACKGROUND OF THE INVENTION

1. Field of the Invention

The present invention relates to a sheet feeder for feeding sheets toward an image transfer station one by one. More particularly, the present invention relates to a sheet feeding device capable of again feeding, when failed to feed a sheet, the same sheet by retry control and a printer including the same.

2. Description of the Background Art

A sheet feeding device included in a stencil printer or similar printer is constructed to feed sheets stacked on a sheet tray with a feed roller or pickup roller one by one toward a registration roller pair, the top sheet being first. A leading edge sensor responsive to the leading edge of the sheet is positioned upstream of the registration roller pair in the direction of sheet feed. When the leading edge sensor senses the leading edge of the sheet, the feed roller further conveys the sheet by a preselected distance until the leading edge of the sheet abuts against the nip of the registration roller pair.

The preselected distance mentioned above is longer than a distance between the leading edge sensor and the nip of the registration roller pair, so that the sheet is caused to form a loop due to excessive feed and has its skew corrected thereby. The registration roller pair selectively opens or closes in synchronism with the rotation of a print drum or similar image carrier, conveying the sheet to an image transfer station such that the preselected position of the sheet meets the leading edge of an image.

When the leading edge sensor does not sense the leading edge of the sheet within a preselected period of time, a controller included in the printer determines that the sheet feeding device has failed to feed to sheet (jam), and urges the operator of the printer to remove the sheet.

However, it is time- and labor-consuming for the operator to stop the operation of the printer and then remove the jamming sheet. Particularly, in a stencil printer that usually outputs a number of prints, the operator often leaves the printer over a long period of time until the end of printing. In this respect, a feed failure occurred in the absence of the operator results in a substantial time loss. In light of this, it is a common practice to execute so-called retry control, or refeed control, for again feeding a sheet not fed due to a failure to thereby prevent the operation of the printer from being interrupted as far as possible.

Japanese Patent Laid-Open Publication No. 7-277553, for example, discloses a document conveying device with a retry control capability and configured to again convey, when a document is not sensed in a preselected period of time, the document at half a speed. By reducing the conveying speed, the document conveying device increases friction to act between the document and a conveyor roller and therefore a conveying ability.

Japanese Patent Laid-Open Publication No. 8-169632 teaches a sheet feeding device constructed to increase, in the event of retry control, the drive speed of a drive motor assigned to a feed roller, thereby again feeding a sheet not fed due to a failure without lowering the overall printing speed. Further, Japanese Patent Laid-Open Publication No. 2000-132002 proposes an image forming apparatus constructed such that when a sheet is not sensed within a preselected period of time, the sheet not fed due to a failure is again fed on the basis of information output from scanning optics at the time when the optics completed scanning one time performs the next scanning.

However, the conventional sheet feeding schemes have the following problem left unsolved. A position at which a sheet not fed due to a failure is stopped is not constant. It is therefore likely that the refeed timing of such a sheet is not matched to the opening/closing timing of a registration roller pair, which is synchronous to the rotation timing of the image carrier. Any error in refeed timing directly translates into the shift of an image on the sheet.

Technologies relating to the present invention are also disclosed in, e.g., U.S. Pat. No. 6,298,778.

SUMMARY OF THE INVENTION

It is an object of the present invention to provide a sheet feeding device capable of accurately effecting the refeed of a sheet not fed due to a failure and a printer including the same.

A sheet feeding device of the present invention capable of again feeding, when failed to feed a sheet, the sheet by retry control includes a sheet tray loaded with a stack of sheets and a feed roller for sequentially feeding the sheets from the sheet tray one by one. A leading edge sensor is positioned downstream of the feed roller in the direction of sheet feed for sensing the leading edge of the sheet fed from the sheet tray. A registration roller pair is positioned downstream of the leading edge sensor in the direction of sheet feed for conveying the sheet toward an image transfer station at a preselected timing. When the retry control is to be executed, control means varies the content of control in accordance with information output from the leading edge sensor.

A printer including the sheet feeding described above device is also disclosed.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
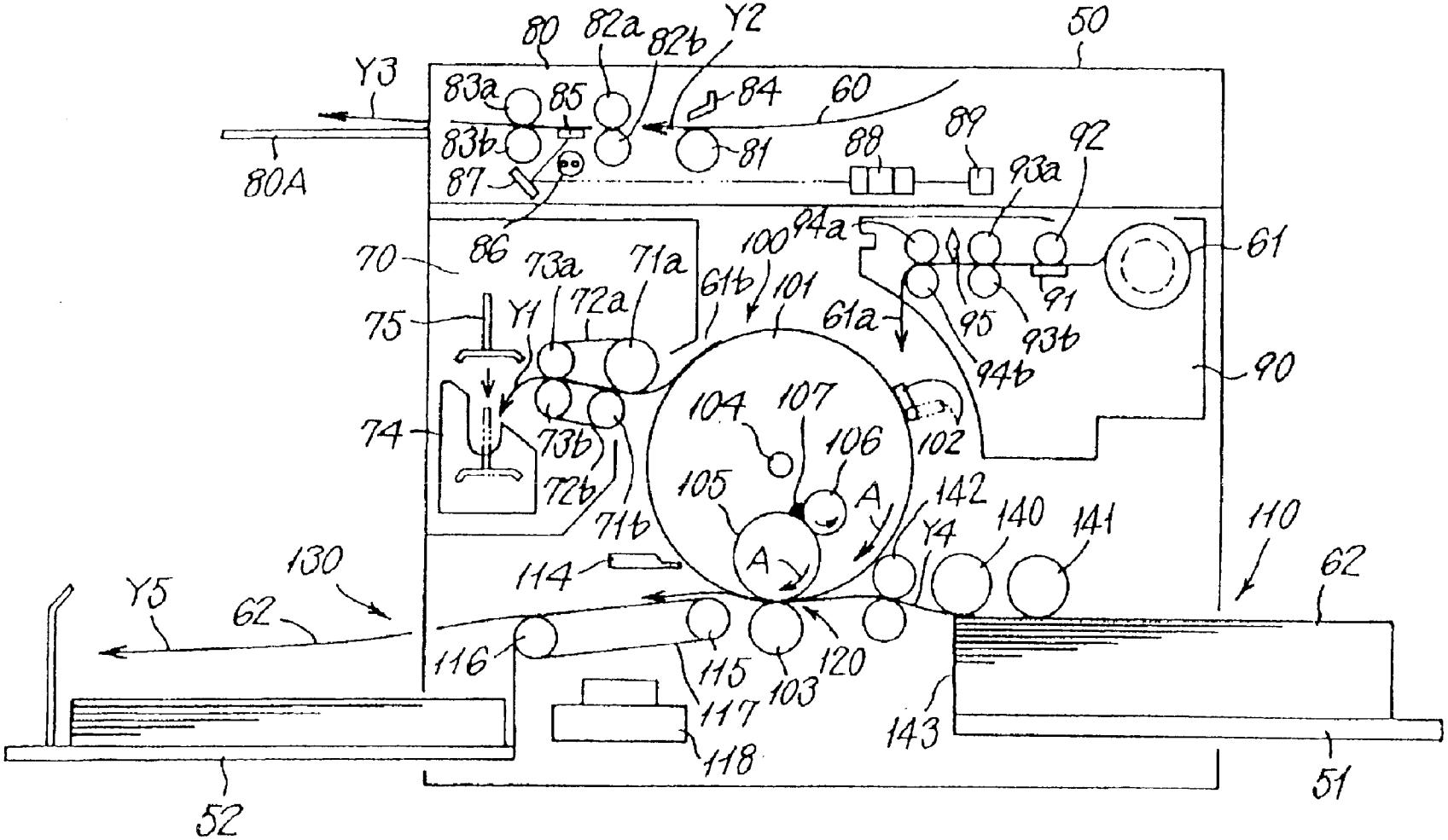
FIG. 1 is a front view showing a printer embodying the present invention.

Referring to FIGS. 1 through 7 of the drawings, a printer embodying the present invention is shown and implemented as a stencil printer by way of example. As shown, the stencil printer includes a printer body 50. An image scanning section 80 is arranged in the upper portion of the printer body 50. A drum section 100 including a porous print drum 101 is disposed below the image scanning section 80 at the center portion of the printer body 50. A master making device 90 is arranged above and at the right-hand side of the drum section 100. A master discharging section 70 is positioned above and at the left-hand side of the drum section 100. A sheet feeding device 110 is positioned below the master making device 90. A pressing section 120 is positioned below the drum section 100 while a print discharging section 130 is positioned below the master discharging section 70.

In operation, the operator of the printer sets a desired document 60 on a document tray, not shown, positioned on the top of the image scanning section 80. The operator then presses a perforation start key provided on a control panel although not shown specifically. In response, the printer executes a master discharging step. More specifically, at the time when the perforation start key is pressed, a used master 61*b*, which is a perforated or cut thermosensitive stencil, is still left on the print drum 101. In the master discharging step, the print drum 101 is rotated counterclockwise, as viewed in FIG. 1. When the tailing edge of the used master 61*b* approaches a pair of peel rollers 71*a* and 71*b* in rotation, the peel roller 71*a* picks up the used master 61*b*.

An endless belt 72*a* is passed over the peel roller 71*a* and a roller 73*a* positioned at the left-hand side of the peel roller 71*a*. Likewise, an endless belt 72*b* is passed over the peel roller 71*b* and a roller 73*b* positioned at the left-hand side of the peel roller 71*b*. The belts 72*a* and 72*b* cooperate to convey the used master 61*b* in a direction indicated by an arrow Y1 in FIG. 1 and discharge it into a waste master box 74. At this instant, the print drum 101 is continuously rotated counterclockwise. A presser plate 75 is lowered into the waste master box 74 to compress it within the box 74.

The image scanning section 80 reads the document 60 in parallel with the master discharging step. More specifically, a pickup roller 81 pays out the document 60 from the document tray. An upstream pair of rollers 82*a* and 82*b* and a downstream pair of rollers 83*a* and 83*b* in rotation sequentially convey the document 60 picked up in directions Y2 and Y3. When a plurality of documents 60 are stacked on the document tray, a separator blade 84 causes only the lowermost document to be paid out. When the document 60 is conveyed by the above roller pairs along a glass platen, a fluorescent lamp or light source 86 illuminates the document. The resulting imagewise reflection from the document 60 is reflected by a mirror 87 and then incident to a CCD (Charge Coupled Device) image sensor 89 via a lens 88. In this manner, the document 60 is read by a conventional reduction type scanning system.

The document 60 scanned by the image scanning section 80 is driven out of the printer body 50 to a tray 80A. An analog signal output from the CCD image sensor 89 is sent to an AD (Analog-to-Digital) converter, not shown, built in the printer body 50 and converted to a digital image signal thereby.

A master making step based on the above digital image data and a master feeding step are executed in parallel with the document scanning step. More specifically, a thermosensitive stencil 61 is paid out from a stencil roll set at a preselected position in the master making device 90. A platen roller 92 is pressed against a thermal head 91 via the stencil 61 paid out from the roll. The platen roller 92 and a pair of tension rollers 93*a* and 93*b*, which are in rotation, drive the stencil 61 to the downstream side in the direction of stencil feed.

The thermal head 91 includes a number of fine heat generating elements, not shown, arranged in an array. The heat generating elements are selectively caused to generate heat in accordance with the digital image signal, thereby selectively perforating or cutting a thermoplastic resin film, which will be described later, included in the stencil 61 with heat. As a result, the image data are written in the stencil 61 in the form of a perforation pattern.

A pair of stencil feed rollers 94*a* and 94*b* convey the leading edge of the perforated stencil, labeled 61*a*, toward the circumference of the print drum 101. A guide member, not shown, steers the leading edge of the stencil 61*a* downward with the result that the stencil 61*a* hangs down toward a master damper 102 (indicated by a phantom line) positioned on the print drum 101. At this instant, the master damper 102 is held open at a master feed position. The used master 61*b* has already been removed from the print drum 101 by the previously stated master discharging step.

As soon as the master damper 102 clamps the leading edge of the stencil 61*a* at a preselected timing, the print drum 101 is rotated clockwise (indicated by an arrow A) so as to wrap the stencil 61*a* therearound little by little. A cutter 95 cuts the trailing edge of the perforated stencil 61*a* at a preselected length.

When the perforated stencil 61*a* (master 61*a* hereinafter) cut by the cutter 95 is wrapped around the print drum 101, the master making step and master feeding step end and are followed by a printing step. In the printing step, a feed roller 140 and a pickup roller 141 cooperate to pay out the uppermost one of sheets 62 stacked on a sheet tray 51 toward a registration roller pair 142 in a direction Y4. The registration roller pair conveys it toward the pressing section 120 at a preselected timing synchronous to the rotation of the print drum 101. When the sheet 62 arrives at a nip between the print drum 101 and the press roller 103, a press roller 103, which is usually released from the print drum 101, moves upward and presses the sheet 62 against the master 61*a* wrapped around the print drum 101. Consequently, ink is transferred to the sheet 62 via the porous portion of the print drum 101 and the perforation pattern, not shown, of the master 61*a*, forming an ink image on the sheet.

More specifically, an ink feed pipe 104 disposed in the print drum 101 feeds ink to an ink well 107 formed between an ink roller 105 and a doctor roller 106. The ink roller 105 is pressed against the inner periphery of the print drum 101 and rotated in the same direction as the print drum 101 in synchronism with the rotation speed of the print drum 101. The ink roller 105 therefore feeds the ink to the inner periphery of the print drum 101.

A peeler 114 peels off the sheet 62 carrying the image and coming out of the pressing section 120 from the print drum 101. An endless belt 117 is passed over an inlet roller 115 and an outlet roller 116 and rotated counterclockwise to convey the sheet, or print, 62 toward the print discharging section 130 in a direction Y5. At this instant, a suction fan 118 sucks the print 62 to thereby retain it on the belt 117. Finally, the print 62 is driven out to a print tray 52 as a so-called trial print.

If the trial print is acceptable, then the operator sets a desired number of prints on numeral keys, not shown, and then presses a print start key not shown. In response, the printer repeats the sheet feeding step, printing step and print discharging step described above a number of times corresponding to the desired number of prints.

Figure 2:
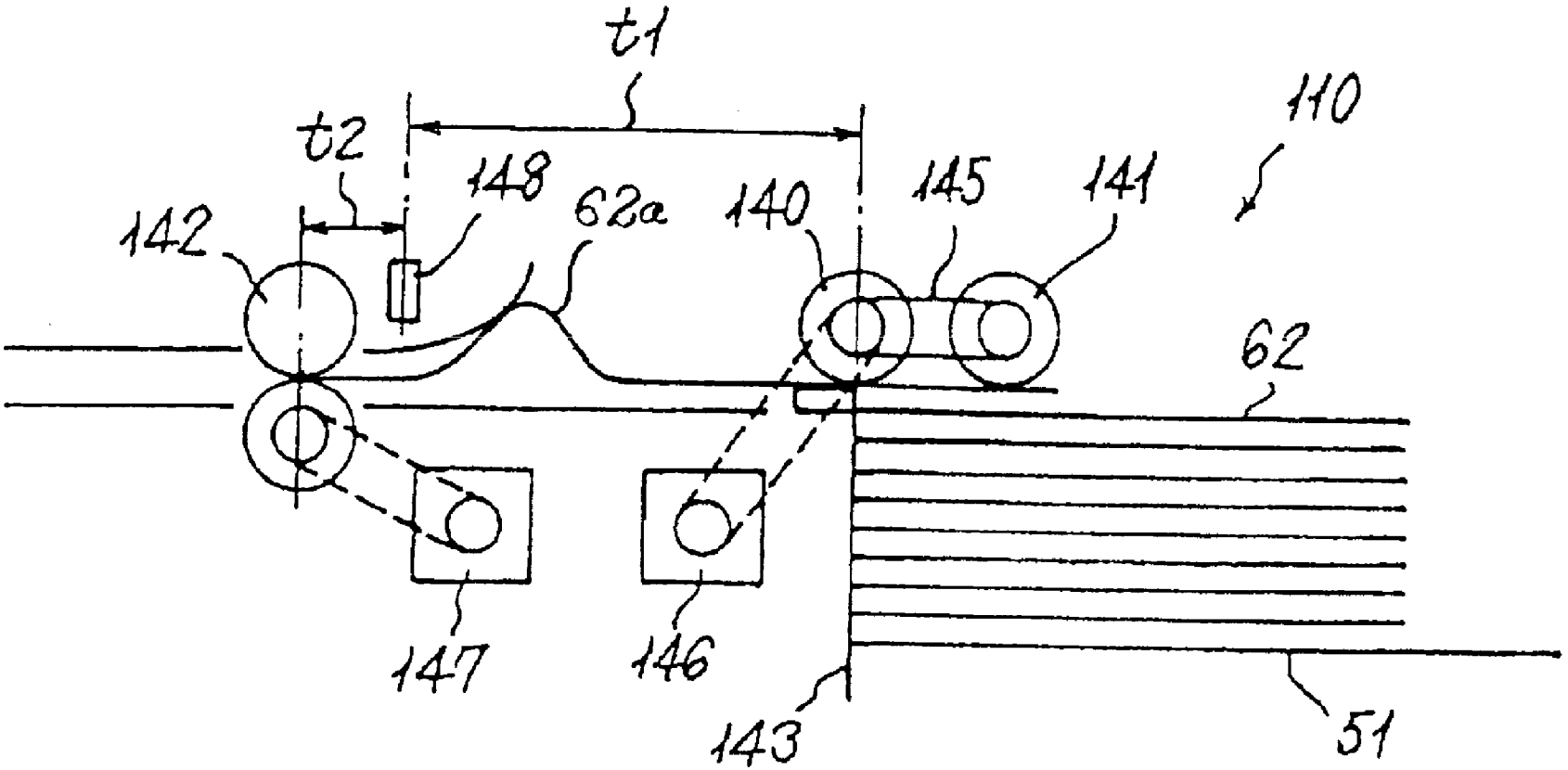
FIG. 2 is a front view showing a sheet feeding device included in the illustrative embodiment.

FIG. 2 shows the sheet feeding device 110 in detail. As shown, the sheet tray 51 loaded with a stack of sheets 62 is configured to be movable up and down. A sense/control section, not shown, causes the sheet tray 51 to stop at a preselected level or height. The feed roller 140 drives the top sheet 62 toward the downstream side in the direction of sheet feed while the pickup roller 141 conveys the sheet 62 toward the feed roller 140. A front plate 143 aligns the front edges of the sheets 62 stacked on the sheet tray 51 in the direction of sheet feed. The registration roller pair 142 is also included in the sheet feeding device 110. The pickup roller 141 is rotated in synchronism with the feed roller 140 by a timing belt 145.

A sheet feed motor 146, which is a stepping motor, causes the feed roller 140 to rotate. A registration motor 147, which is also a stepping motor, causes one roller of the registration roller pair 142 to rotate.

A leading edge sensor 148 is positioned upstream of the registration roller pair 142 in the direction of sheet feed and plays the role of leading edge sensing means responsive to the leading edge of the sheet 62. The leading edge sensor 148 may be implemented by a reflection type photosensor by way of example. In the illustrative embodiment, a distance t1 between the feed roller 140 and the leading edge sensor 148 is selected to be 77.13 mm while a distance t2 between the registration roller pair 142 and the sensor 148 is selected to be 8 mm.

The registration roller pair 142 selectively opens or closes, i.e., rollers constituting it move into or out of contact with each other in synchronism with the rotation of the print drum 101. The registration roller pair 142 starts exerting a nip pressure when the rotation angle of the print drum 101 is 165° and then fully closes to exert conveying pressure (nip pressure ON) when the rotation angle is 176°.

More specifically, during usual sheet feed operation, the registration roller pair 142 remains closed when the leading edge of the sheet 62 passes the leading edge sensor 148. After the leading edge sensor 148 has sensed the leading edge of the sheet 62, the sheet 62 is further conveyed by an excessive amount exceeding the distance t2 (8 mm) and caused to form a loop 62*a* thereby. As a result, the leading edge of the sheet 62 abuts against the nip of the registration roller pair 142 and has its skew in the axial direction of the registration roller pair 142 corrected thereby. Subsequently, the registration roller pair 142 conveys the sheet 62 toward the pressing section or image transfer station 120 at a preselected timing.

The sheet feed motor 146 causes the feed roller 140 to start feeding the sheet 62 when the rotation angle of the print drum 101 is 97.3° sensed by a sheet feed start sensor 149 (see FIG. 4), i.e., by being triggered by the output of the sensor 149. The rotation speed of the sheet feed motor 146 is constant without regard to the linear velocity of the print drum 101. The print drum 101 has a circumference of 190*n*. The print drum 101 is selectively rotatable at any one of speeds of 15 rpm (revolutions per minute), 30 rpm, 60 rpm, 75 rpm, 90 rpm, 105 rpm and 120 rpm.

Figure 3:
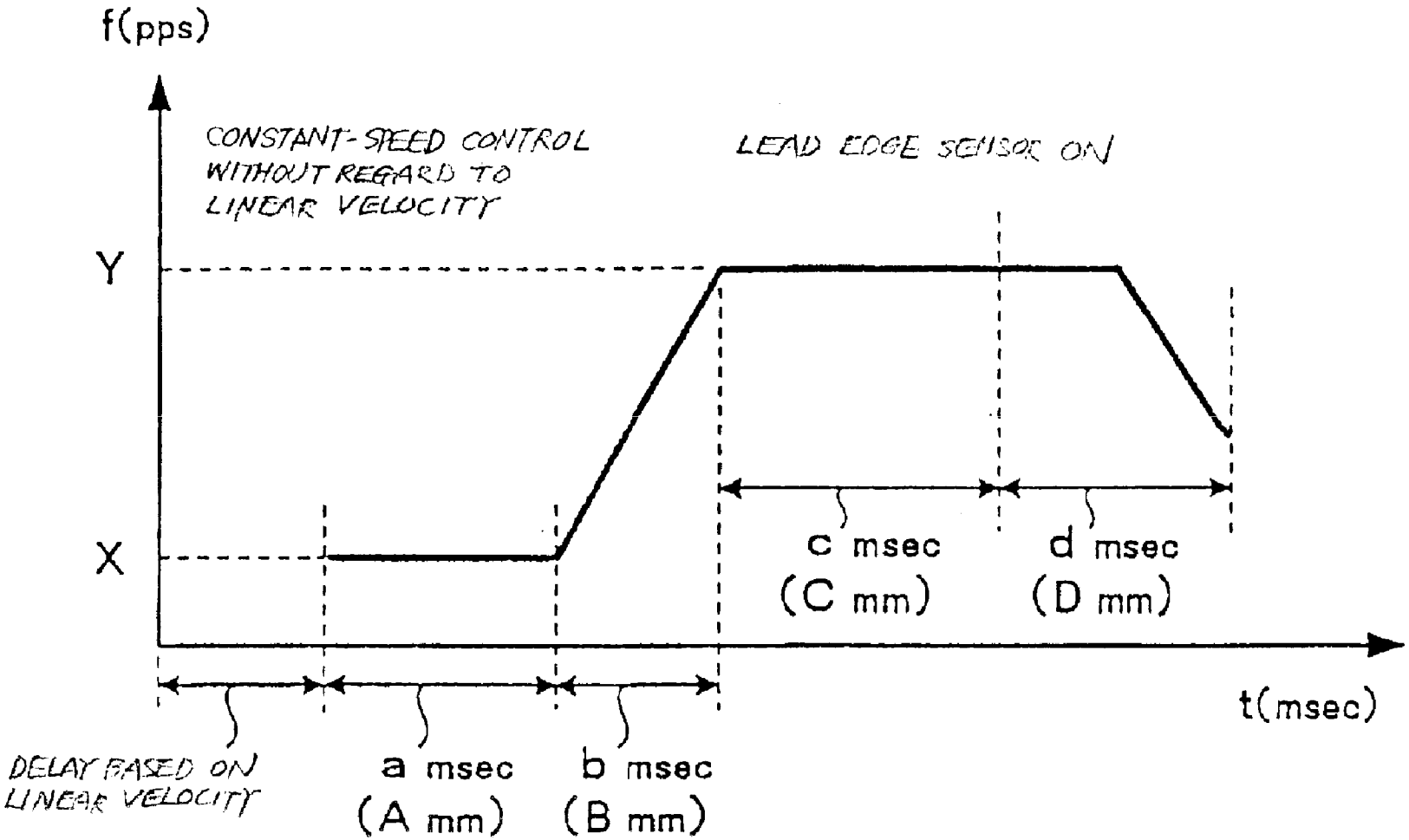
FIG. 3 is a timing chart showing the rotation of a feed roller included in the sheet feeding device of FIG. 2.

FIG. 3 is a timing chart showing the rotation of the feed roller 140. As shown, after the leading edge sensor 148 has sensed the leading edge of the sheet 62, the rotation of the feed roller 140 is slowed down at a preselected number of steps.

Figure 4:
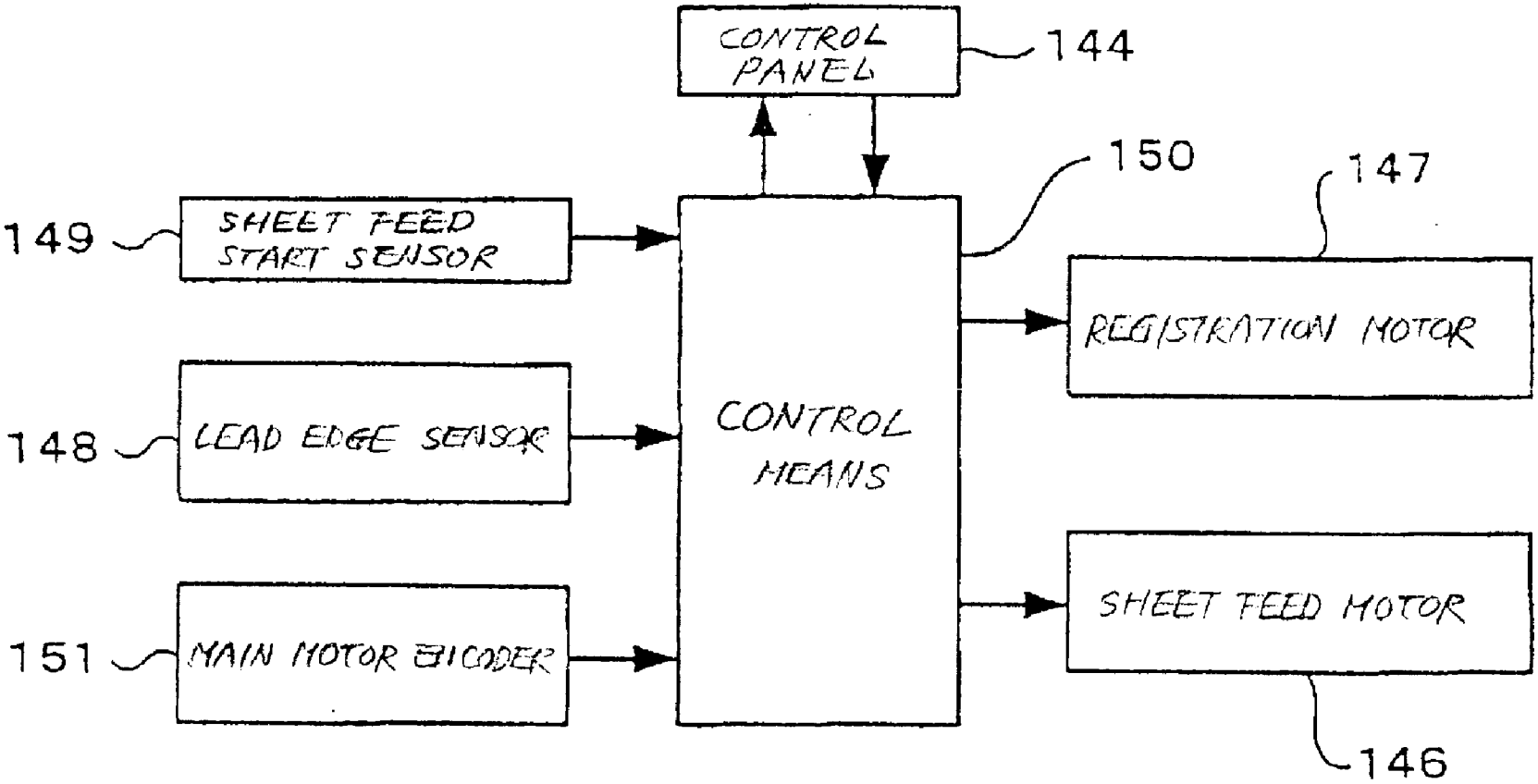
FIG. 4 is a schematic block diagram showing a control system included in the illustrative embodiment.

FIG. 4 shows a control system included in the illustrative embodiment. As shown, the control system includes control means 150 implemented as a microcomputer including a CPU (Central Processing Unit), a ROM (Read Only Memory), a RAM (Random Access Memory), and an I/O (Input/Output Interface). The sheet feed motor 146, registration motor 147, leading edge sensor 148 and sheet feed start sensor 149 are connected to the control means 150. Also connected to the control means 150 are a control panel 144 and a main motor encoder 151. The main motor encoder 151 is mounted on a main motor, not shown, that rotates the print drum 101.

Retry control, or refeed control, unique to the illustrative embodiment will be described hereinafter. Retry is executed when the sheet 62 is paid out of the sheet tray 51, but jams a transport path due to a feed failure. More specifically, the sheet 62 is determined to be not fed due to a failure when the leading edge sensor 148 does not turn on after the sheet feed motor 146 has rotated by a preselected number of steps. Basically, the leading edge sensor 148 does not turn on in the event of retry because retry is executed only when a sheet jam is sensed. However, the leading edge sensor 148 may have been turned on in the event of retry. For example, despite that the sensor 148 has turned off when a feed error has been detected, the sheet 62 is, when the sheet feed rotor 146 is deenergized, slightly conveyed due to the vibration of the printer or stretched from its loop position and turns on the sensor 148.

Figure 5:
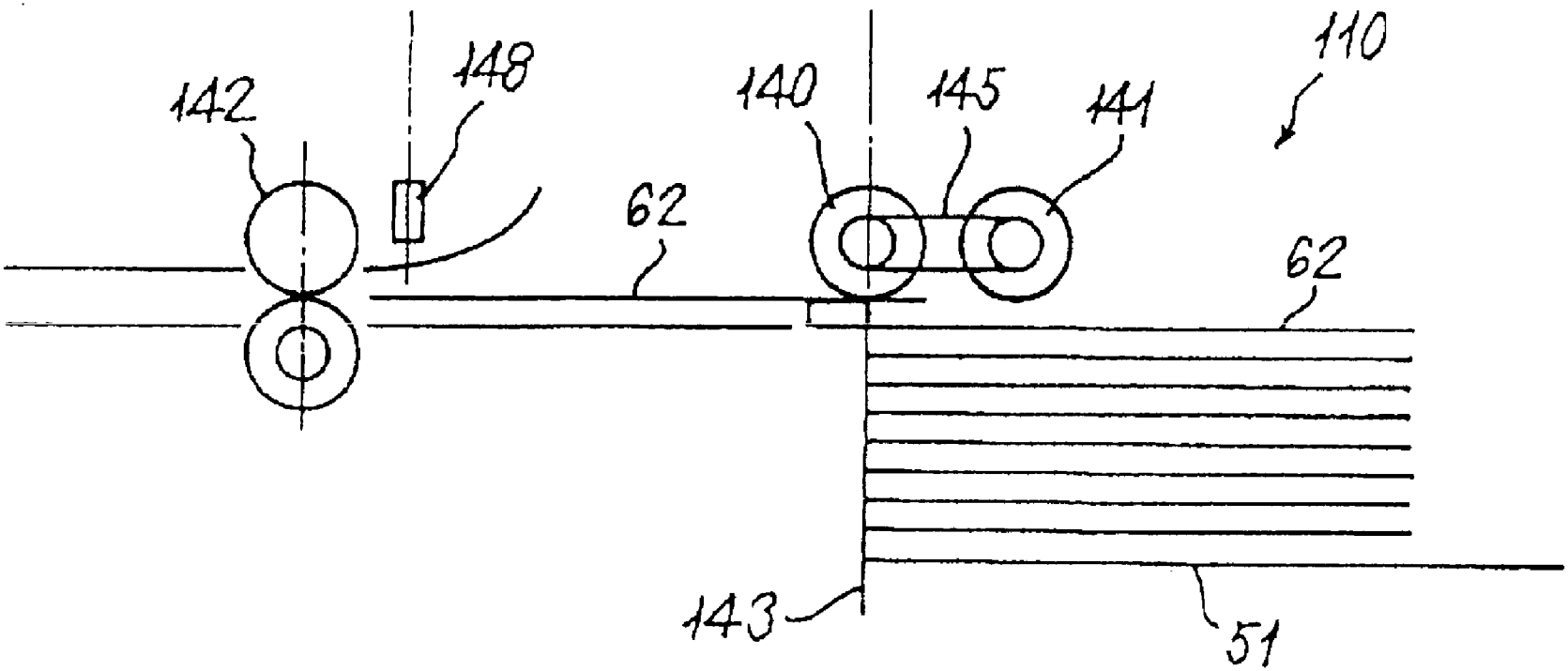
FIG. 5 is a front view showing a condition wherein a leading edge sensor included in the sheet feeding device is in an ON state.

FIG. 5 shows a condition wherein the leading edge sensor 148 is turned on at the time of retry due to the occurrence described above. If the leading edge sensor 148 is turned on in the event of retry, then it is difficult to determine a position where the leading edge of the sheet 62 is located, i.e., to determine a distance which the leading edge of the sheet 62 has moved away from the sensor 148. In this case, the illustrative embodiment conveys, when the registration roller pair 142 is closed, the sheet 62 by a preselected distance until the leading edge of the sheet 62 abuts against the nip of the registration roller pair 142. The preselected distance is 8 mm (t2) in the illustrative embodiment, as will be described more specifically later. Because the leading edge position of the sheet 62 is not constant, as stated above, the amount of the loop of the sheet 62 is, of course, not constant when unconditionally conveyed by 8 mm.

Figure 6:
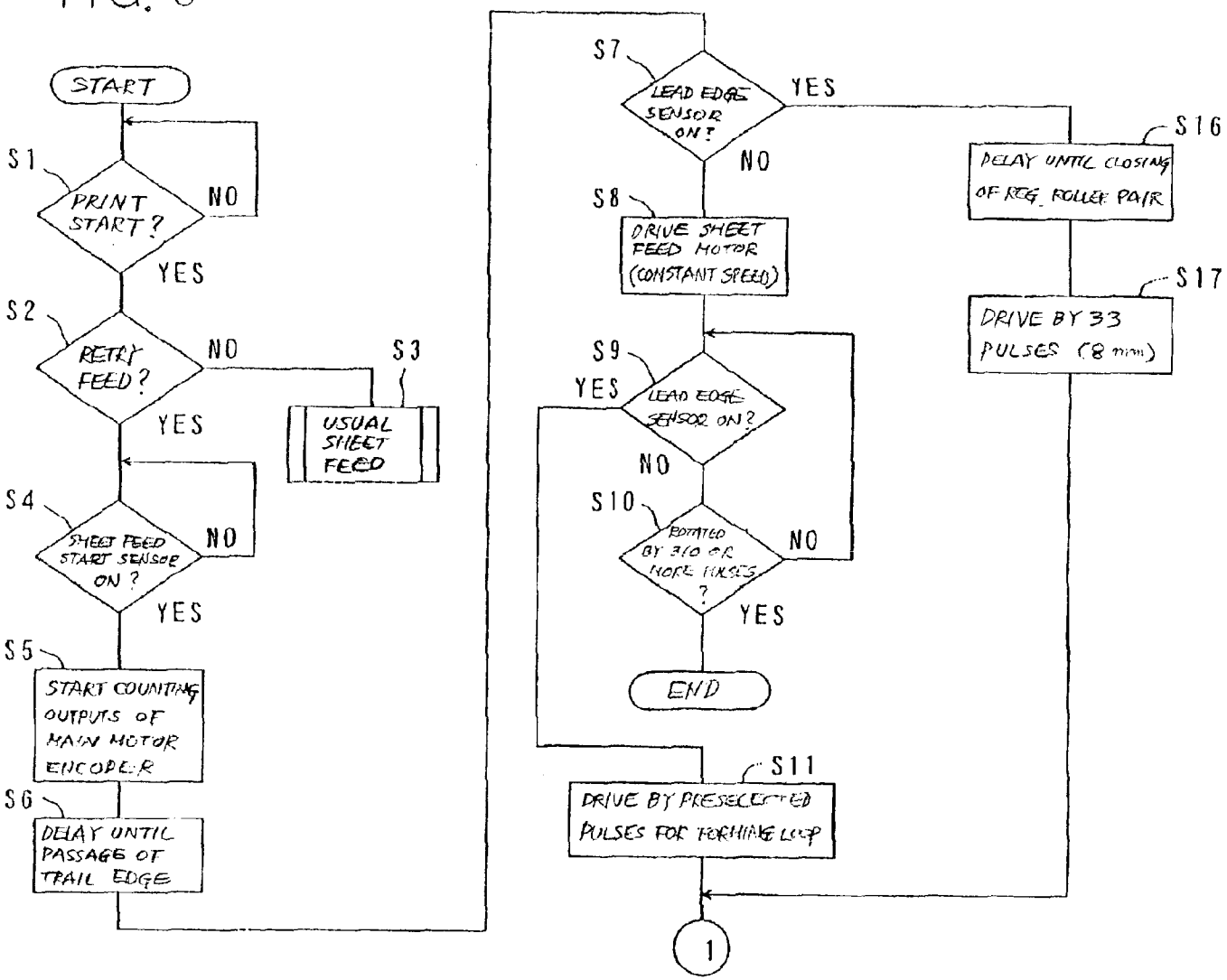
FIG. 6 is a flowchart demonstrating part of a specific operation of the illustrative embodiment.
Figure 7:
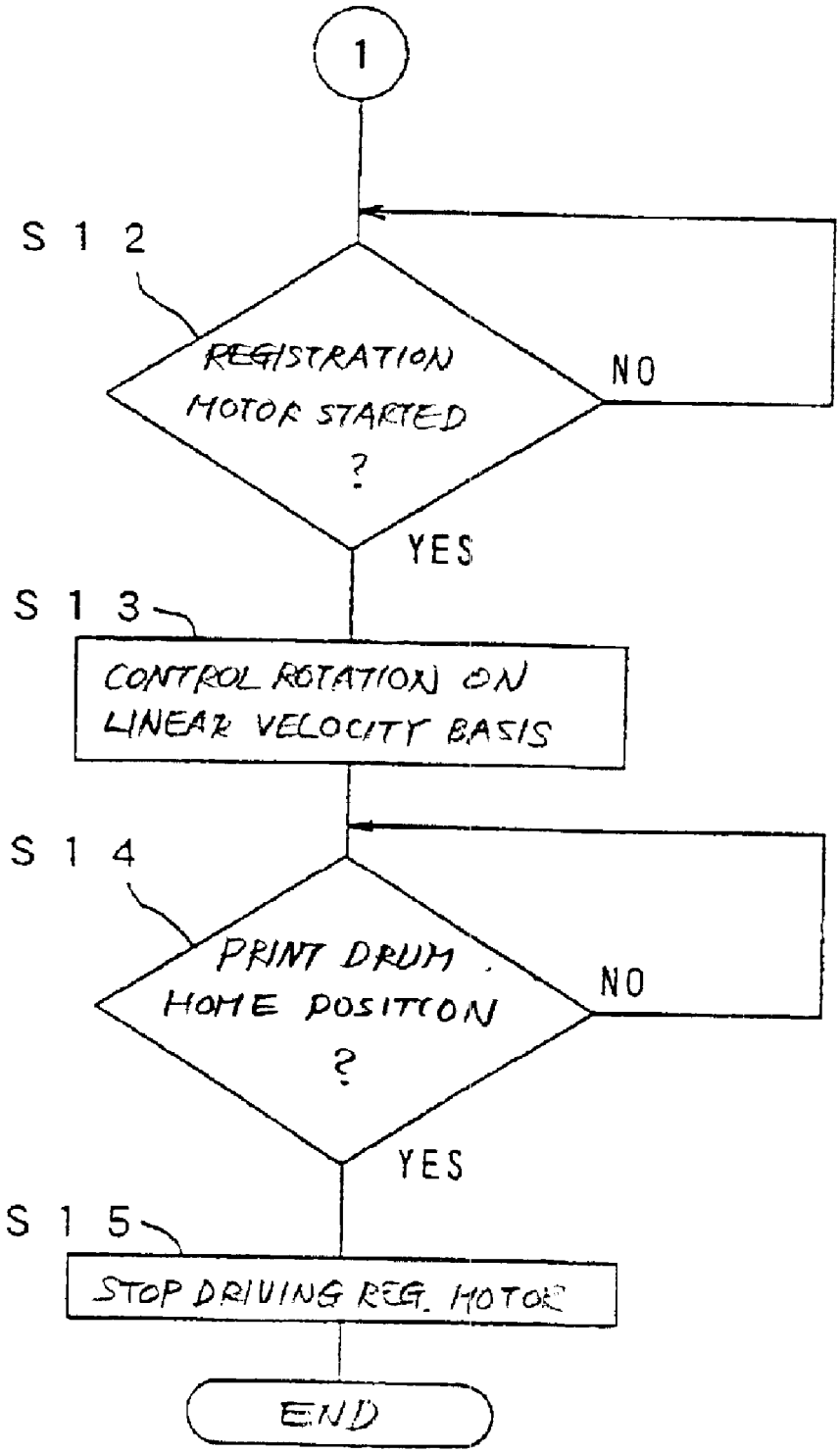
FIG. 7 is a flowchart demonstrating the other part of the operation of the illustrative embodiment.

The retry control of the illustrative embodiment to be executed by the control means 150 will be described with reference to FIGS. 6 and 7. As shown, the control means 150 first determines that whether or not the printer is in printing operation (step S1). If the answer of the step S1 is positive (YES), then the control means 150 determines whether or not a sheet 62 should be fed by retry processing (step S2). Retry is executed only when a sheet 62 paid out from the sheet tray 51 jams the transport path, i.e., it is not fed due to a feed failure, as stated earlier. If the answer of the step S2 is negative (NO), then the control means 150 executes usual sheet feed processing (step S3).

If the answer of the step S2 is YES, meaning that retry should be effected, then the control means 150 determines whether or not the sheet feed start sensor 149 has turned on, i.e., whether or not the print drum 101 has reached an angular position of 97.3° (step S4). If the answer of the step S4 is YES, then the control means 150 starts counting the consecutive outputs of the main motor encoder 151 (step S5). The control means 150 then waits until a time at which the trailing edge of the sheet 62 paid out is expected to move away from the front plate 143 (step S6).

Subsequently, the control means 150 determines whether or not the leading edge sensor 148 has turned on (step S7).

If the answer of the step S7 is NO, then the control means 150 determines whether or not the sheet feed motor 146 has been rotated by 310 or more pulses (step S10). If the answer of the step S10 is YES, then the control means 150 determines that the retry has failed, interrupts the operation of the printer, and displays an jam message on an LCD (Liquid Crystal Display), not shown, mounted on the control panel 144. The jam message may be "Pickup error: Please remove a jamming sheet." by way of example. The jam message appearing on the LCD urges the operator of the printer to remove the jamming sheet.

On the other hand, if the answer of the step S9 is YES, meaning that the leading edge sensor 148 is in an ON state, then the control means 150 causes the sheet feed motor 146 to rotate by a preselected number of steps for thereby causing the sheet 62 to form an adequate loop (step S11). The control means 150 then determines whether or not the registration roller pair 142 has started rotating (step S12). If the answer of the step S12 is YES, then the control means 150 causes the registration roller pair 142 to rotate in accordance with the linear velocity of the print drum 101 (step S13). Subsequently, the control means 150 determines, based on the outputs of the main motor encoder 151, whether or not the print drum 101 has reached a home position where it can be removed from the printer body (step S14). If the answer of the step S14 is YES, then the control means 150 causes the registration roller 142 to stop rotating (step S15).

If the answer of the step S7 is YES (see a condition shown in FIG. 5), then the control means 150 waits until the registration roller pair 142 closes (step S16). As soon as the registration roller pair 142 closes (YES, step S16), the control means 150 causes the sheet feed motor 146 to rotate by thirty-three pulses (step S17). It is to be noted that thirty-three pulses cause the sheet 62 to be fed by 8 mm and form a loop.

Figure 8:
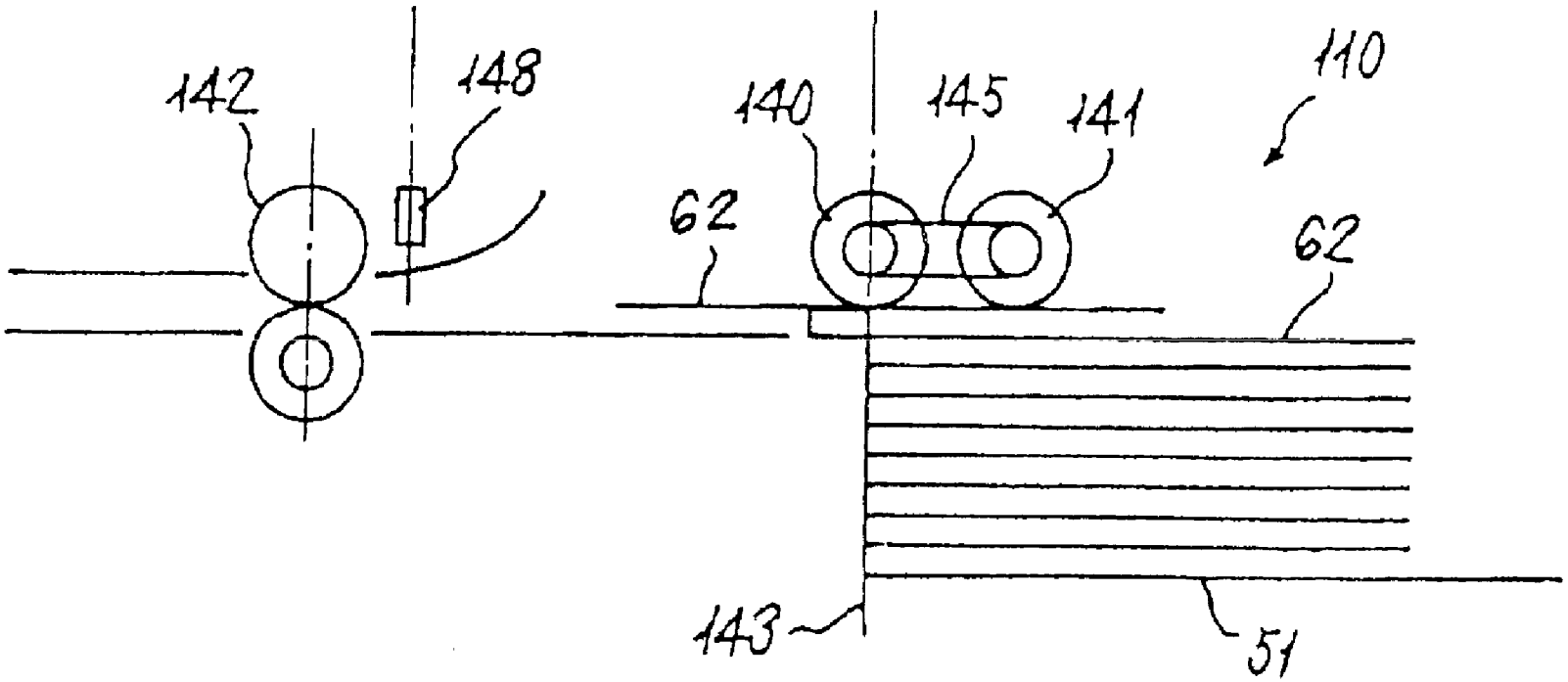
FIG. 8 is a front view showing a sheet feeding device representative of an alternative embodiment of the present invention.

Reference will be made to FIG. 8 for describing an alternative embodiment of the present invention. In FIG. 8, structural elements identical with the structural elements shown in FIG. 5 are designated by identical reference numerals and will not be described specifically in order to avoid redundancy. The illustrative embodiment pertains to retry control to be executed when the leading edge sensor 148 is not in an ON state at the time of retry. Even if the leading edge sensor 148 is not in an ON state, the position of the sheet 62 can be determined if the sheet feed motor 146 is rotated until the sensor 148 turns on, as stated in relation to the previous embodiment. However, it is likely that the rotation of the sheet feed motor 146 is not matched to the opening/closing movement of the registration roller pair 142, depending on the position of the sheet 62 at the time of retry.

As shown in FIG. 8, when the leading edge of the sheet 62 is positioned a substantial distance short of the leading edge sensor 148, the control means 150 drives the sheet feed motor 146 in order to convey the sheet 62. When the leading edge sensor 148 senses the leading edge of the sheet 62, the control means 150 determines whether or not the registration roller pair 142 is closed and ready to convey the sheet 62. If the registration roller pair 142 is closed, then the control means 150 causes the sheet 62 to be further conveyed by a preselected distance until the leading edge of the sheet 62 abuts against the nip of the registration roller pair 142.

Assume that the registration roller pair 142 is not closed when the leading edge sensor 148 senses the leading edge of the sheet 62. Then the control means 150 causes the feed roller 140 to stop rotating, waits until the registration roller pair 142 closes, and again causes the feed roller 140 to rotate to convey the sheet 62 by the preselected distance until the sheet 62 abuts against the nip of the registration roller pair 142.

Figure 9:
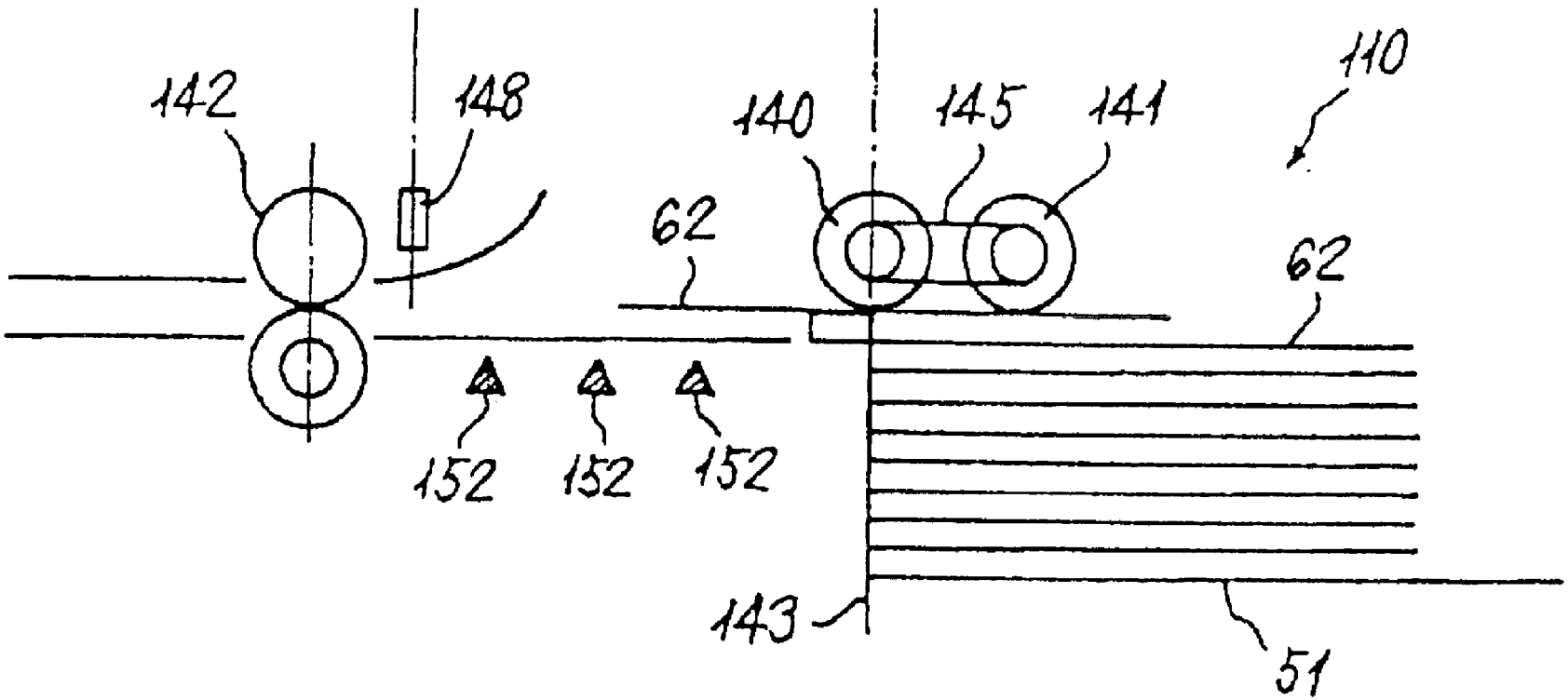
FIG. 9 is a front view showing a sheet feeding device representative of another alternative embodiment of the present invention.

FIG. 9 shows another alternative embodiment of the present invention. As shown, a plurality of sheet sensors 152 are arranged between the leading edge sensor 148 and the feed roller 140 at preselected intervals in the direction of sheet feed. The sheet sensors 152 may be implemented by a reflection type photosensor reach. In the illustrative embodiment, the retry start timing is varied in accordance with the position (order) of the sheet sensor 152 sensing the sheet 62 and matched to the opening/closing timing of the registration roller pair 142 thereby.

Figure 10:
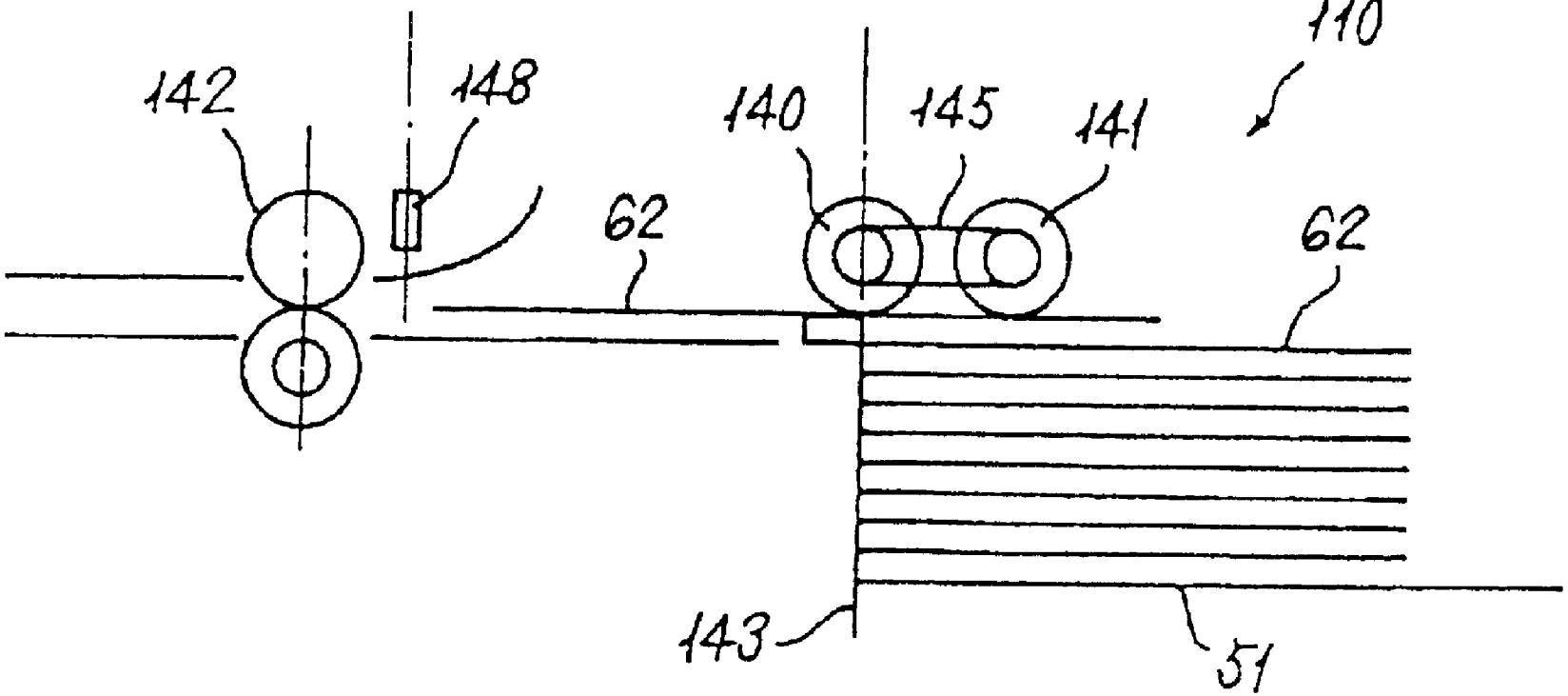
FIG. 10 is a front view showing a sheet feeding device representative of further alternative embodiment of the present invention.

As shown in FIG. 10, assume that the leading edge of the sheet 62 not fed due to a feed failure is positioned in the vicinity of the leading edge sensor 148 at the time of retry. Then, even if the sheet 62 is conveyed by the preselected distance after the turn-on of the leading edge sensor 148, the leading edge of the sheet 62 passes the registration roller pair 142 by a distance corresponding to the loop because the registration roller pair 142 is not closed then. As a result, when the registration roller pair 142 is closed and caused to start rotating at a preselected timing later, an image is shifted on the sheet 62 by the above distance. To obviate such a shift of an image, the control means 150 should only stop the rotation of the feed roller 140 after the turn-on of the leading edge sensor 148, wait until the registration roller pair 148 closes, and then convey the sheet 62 by the preselected distance, as described in relation to the embodiment shown in FIG. 8.

Further, the sheet sensors 152 shown in FIG. 9 may be used to match the retry start timing to the opening/closing timing of the registration roller pair 142.

Hereinafter will be described still another alternative embodiment constructed to obviate the shift of an image without interrupting the rotation of the feed roller 140 or resorting to the sheet sensors 152. In the illustrative embodiment, the control means 150 counts an interval between the time when retry starts and the time when the leading edge sensor 148 senses the sheet 62. Assume that the above interval does not exceed a preselected period of time in which the leading edge of the sheet 62 fed by retry will pass the nip of the registration roller pair 142. Then, the control means 150 calculates an amount by which the leading edge of the sheet 62 will protrude from the nip of the registration roller pair 142. Subsequently, the control means 150 varies, i.e., delays the timing for causing the registration roller pair 142 to start rotating in accordance with the amount of projection calculated.

More specifically, the distance t2 between the leading edge sensor 148 and the nip of the registration roller pair 142 is known beforehand, as stated earlier. Therefore, the amount of projection of the sheet 62 from the above nip can be produced if a time interval between the turn-on of the leading edge sensor 148 and the closing of the registration roller pair 142 is counted and combined with the conveying speed of the feed roller 140.

Alternatively, a table listing a relation between the amount of projection and the rotation start timing of the registration roller pair 142 may be stored in the ROM of the control means 150 beforehand. The above relation is achievable by, e.g., experiments or computer simulations. In such a case, a period of time by which the rotation of the registration roller pair 142 should be delayed will be selected in accordance with the amount of projection calculated.

A further alternative embodiment of the present invention will be described hereinafter. In the illustrative embodiment, the control means 150 counts an interval between the time when retry starts and the time when the leading edge sensor 148 senses the leading edge of the sheet 62. This interval is used to calculate a distance between the leading edge of the sheet 62 not fed due to a feed failure and the leading edge sensor 148. Subsequently, the control means 150 varies, i.e., delays the timing for causing the registration roller pair 142 to start rotating in accordance with the distance calculated.

More specifically, a distance between the leading edge of the sheet 62 and the leading edge sensor 148 can be calculated by using the conveying speed of the feed roller 140 and the interval counted. In the illustrative embodiment, a table listing a relation between the distance and the rotation start timing of the registration roller 142 determined beforehand may also be stored in the ROM of the control means 150, in which case a rotation start timing matching with the distance calculated will be selected.

In any one of the embodiments shown and described, when the interval between the time when retry starts and the time when the leading edge sensor 148 senses the leading edge of the sheet 62 exceeds a reference interval, the control means 150 may interrupt the operation of the printer by determining that the retry has failed. It is to be noted that the reference interval is only illustrative and may be replaced with a reference number of rotations of the feed roller 140 or a reference amount corresponding thereto, e.g., a reference number of steps. That is, when the number of rotations or the number of steps counted during the above interval exceeds a reference value, the control means 150 may interrupt the operation of the printer.

In summary, it will be seen that the present invention provides a sheet feeding device and a printer including the same having various unprecedented advantages, as enumerated below.

(1) When a sheet paid out from a sheet tray is not fed due to a feed error, it can be surely fed by retry.

(2) The leading edge of a sheet is prevented from passing the nip of a registration roller pair at an unexpected timing, so that an image is free from dislocation on the sheet.

(3) Because the position of the leading edge of a sheet can be grasped, the sheet can surely form a loop and can have its skew corrected. This is also successful to protect an image from dislocation on the sheet.

(4) It is possible to protect an image from dislocation while maintaining the high-speed operation of the printer and without resorting to any additional sheet sensing means.

(5) A trouble ascribable to a jam of the kind not feasible for retry can be obviated.

Various modifications will become possible for those skilled in the art after receiving the teachings of the present disclosure without departing from the scope thereof.

What is claimed is:

1. A sheet feeding device comprising;

a tray configured to receive a plurality of sheets;

a feed roller configured to feed a top sheet of the plurality of sheets;

means for sensing a leading edge of the top sheet;

registration rollers configured to convey the top sheet toward an image transfer station at a preselected timing; and means for controlling said feed roller to perform a feed operation when the top sheet is being successfully fed, a first re-feed operation when the top sheet has experienced a feed failure and the leading edge is sensed by the means for sensing, and a second re-feed operation when the top sheet has experienced a feed failure and the leading edge is not sensed by the means for sensing, the first and second re-feed operations differing in execution from one another.

2. The sheet feeding device as claimed in claim 1, wherein the means for controlling is configured to cause said feed roller to convey said top sheet by a preselected distance until the leading edge of said top sheet abuts against a nip of said registration rollers after the registration rollers are brought into contact with one another when the means for sensing senses the leading edge.

3. The sheet feeding device as claimed in claim 1, wherein the means for controlling is configured to cause said feed roller to convey said top sheet until the means for sensing senses said leading edge, and then to convey said top sheet by a preselected distance until said leading edge abuts against a nip of said registration rollers when the means for sensing does not sense the leading edge.

4. The sheet feeding device as claimed in claim 3, wherein the means for controlling is configured to determine whether said registration rollers are closed to convey said top sheet, and if said registration rollers are closed to cause said feed roller to convey said top sheet by the preselected distance when the means for sensing senses the leading edge.

5. The sheet feeding device as claimed in claim 3, wherein the means for controlling is configured to determine whether said registration rollers are closed to convey said top sheet, if said registration rollers are not closed to interrupt a rotation of said feed roller, and to cause said feed roller to rotate to feed said top sheet by the preselected distance when the means for sensing senses the leading edge.

6. A sheet feeding device capable of again feeding, when failed to feed a sheet, the sheet by retry control, the sheet feeding device comprising:

a sheet tray configured to be loaded with a stack of sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing;

control means for controlling the feed roller and the registration roller pair; and a plurality of sheet sensing means arranged between said leading edge sensing means and said feed roller at preselected intervals, wherein said control means is configured to vary a timing at a time of retry in accordance with a position of sheet sensing means sensing the sheet, wherein when the retry control is to be executed, the control means is configured to vary a content of control in accordance with information output from the leading edge sensing means, and wherein when the leading edge sensing means does not sense the leading edge of the sheet not fed due to a feed failure, the control means is configured to cause the feed roller to convey the sheet until the leading edge sensing means senses the leading edge, and then to convey the sheet by a preselected distance until the leading edge abuts against a nip of the registration roller pair.

7. A sheet feeding device capable of again feeding, when failed to feed a sheet, the sheet by retry control, the sheet feeding device comprising:

a sheet tray configured to be loaded with a stack of sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing; and control means for controlling the feed roller and the registration roller pair;

wherein when the retry control is to be executed, the control means is configured to vary a content of control in accordance with information output from the leading edge sensing means, wherein when the leading edge sensing means does not sense the leading edge of the sheet not fed due to a feed failure, the control means is configured to cause the feed roller to convey the sheet until the leading edge sensing means senses the leading edge, and then to convey the sheet by a preselected distance until the leading edge abuts against a nip of the registration roller pair, and wherein said control means is configured to count an interval between at time when retry starts and a time when said leading edge sensing means senses the leading edge of the sheet, to calculate, if said interval does not exceed a preselected interval, an amount by which said leading edge will protrude from the nip of said registration roller pair, and to vary a rotation start timing of said registration roller pair in accordance with said amount calculated.

8. A sheet feeding device capable of again feeding, when failed to feed a sheet, the sheet by retry control, the sheet feeding device comprising:

a sheet tray configured to be loaded with a stack of sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing; and control means for controlling the feed roller and the registration roller pair;

wherein when the retry control is to be executed, the control means is configured to vary a content of control in accordance with information output from the leading edge sensing means, wherein when the leading edge sensing means does not sense the leading edge of the sheet not fed due to a feed failure, the control means is configured to cause the feed roller to convey the sheet until the leading edge sensing means senses the leading edge, and then to convey the sheet by a preselected distance until the leading edge abuts against a nip of the registration roller pair, and wherein said control means is configured to count an interval between a time when retry starts and a time when said leading edge sensing means senses the leading edge of the sheet, to calculate, based on said interval, a distance between the leading edge of said sheet and said leading edge sensing means, and to vary, based on said distance, a rotation start timing of said registration roller pair.

9. A sheet feeding device capable of again feeding, when failed to feed a sheet, the sheet by retry control, the sheet feeding device comprising:

a sheet tray configured to be loaded with a stack of sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing; and control means for controlling the feed roller and the registration roller pair;

wherein when the retry control is to be executed, the control means is configured to vary a content of control in accordance with information output from the leading edge sensing means, and wherein said control means is configured to count an interval between a time when retry starts and a time when said leading edge sensing means senses the leading edge of the sheet, and to interrupt, if said interval exceeds a reference interval, an operation of an apparatus accommodating said sheet feeding device by determining that said retry has failed.

10. A sheet feeding device capable of again feeding, when failed to feed a sheet, the sheet by retry control, the sheet feeding device comprising:

a sheet tray configured to be loaded with a stack of sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing; and control means for controlling the feed roller and the registration roller pair;

wherein when the retry control is to be executed, the control means is configured to vary a content of control in accordance with information output from the leading edge sensing means, and wherein said control means is configured to count either one of a number of rotations of said feed roller and an amount corresponding to said number of rotations and to interrupt, when said number of rotations or said amount exceeds a reference value, an operation of an apparatus accommodating said sheet feeding device by determining that retry has failed.

11. A printer comprising:

a sheet feeding device comprising:

a tray configured to receive a plurality of sheets;

a feed roller configured to feed a top sheet of the plurality of sheets;

means for sensing a leading edge of the top sheet;

registration rollers configured to convey the top sheet toward an image transfer station at a preselected timing; and means for controlling said feed roller to perform a feed operation when the top sheet is being successfully fed, a first re-feed operation when the top sheet has experienced a feed failure and the leading edge is sensed by the means for sensing, and a second re-feed operation when the too sheet has experienced a feed failure and the leading edge is not sensed by the means for sensing, the first and second re-feed operations differing in execution from one another.

12. The printer as claimed in claim 11, wherein the means for controlling is configured to cause said feed roller to convey said top sheet by a preselected distance until the leading edge of said top sheet abuts against a nip of said registration roller pair after the registration rollers are brought into contact with one another when the means for sensing senses the leading edge.

13. The printer as claimed in claim 11, wherein the means for controlling is configured to cause said feed roller to convey said top sheet until the means for sensing senses said leading edge, and then to convey said top sheet by a preselected distance until said leading edge abuts against a nip of said registration rollers when the means for sensing does not sense the leading edge.

14. The printer as claimed in claim 13, wherein the means for controlling is configured to determine whether said registration rollers are closed to convey said top sheet, if said registration rollers are closed to cause said feed roller to convey said top sheet by the preselected distance when the means for sensing senses the leading edge.

15. The printer as claimed in claim 13, wherein the means for controlling is configured to determine whether said registration rollers are closed to convey said top sheet, if said registration rollers are not closed to interrupt a rotation of said feed roller, and to cause said feed roller to rotate to feed said top sheet by the preselected distance when the means for sensing senses the leading edge.

16. A printer comprising:

a sheet feeding device capable of again feeding, when failed to feed a sheet, the sheet by retry control, the sheet feeding device comprising:

a sheet tray configured to be loaded with sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing;

control means for controlling the feed roller and the registration roller pair; and a plurality of sheet sensing means arranged between said leading edge sensing means and said feed roller at preselected intervals, wherein said control means is configured to vary a timing at a time of retry in accordance with a position of sheet sensing means sensing the sheet, wherein when the retry control is to be executed, the control means is configured to vary a content of control in accordance with information output from the leading edge sensing means, and wherein when the leading edge sensing means does not sense the leading edge of the sheet not fed due to a feed failure, the control means is configured to cause the feed roller to convey the sheet until the leading edge sensing means senses the leading edge, and then to convey the sheet by a preselected distance until the leading edge abuts against a nip of the registration roller pair.

17. A printer comprising:

a sheet feeding device capable of again feeding, when failed to feed a sheet, the sheet by retry control, the sheet feeding device comprising:

a sheet tray configured to be loaded with sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing;

control means for controlling the feed roller and the registration roller pair;

wherein when the retry control is to be executed, the control means is configured to vary a content of control in accordance with information output from the leading edge sensing means, wherein when the leading edge sensing means does not sense the leading edge of the sheet not fed due to a feed failure, the control means is configured to cause the feed roller to convey the sheet until the leading edge sensing means senses the leading edge, and then to convey the sheet by a preselected distance until the leading edge abuts against a nip of the registration roller pair, and wherein said control means is configured to count an interval between at time when retry starts and a time when said leading edge sensing means senses the leading edge of the sheet, to calculate, if said interval does not exceed a preselected interval, an amount by which said leading edge will protrude from the nip of said registration roller pair, and to vary a rotation start timing of said registration roller pair in accordance with said amount calculated.

18. A printer comprising:

a sheet feeding device capable of again feeding, when failed to feed a sheet, the sheet by retry control, the sheet feeding device comprising:

a sheet tray configured to be loaded with sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing;

control means for controlling the feed roller and the registration roller pair;

wherein when the retry control is to be executed, the control means is configured to vary a content of control in accordance with information output from the leading edge sensing means, wherein when the leading edge sensing means does not sense the leading edge of the sheet not fed due to a feed failure, the control means is configured to cause the feed roller to convey the sheet until the leading edge sensing means senses the leading edge, and then to convey the sheet by a preselected distance until the leading edge abuts against a nip of the registration roller pair, and wherein said control means is configured to count an interval between a time when retry starts and a time when said leading edge sensing means senses the leading edge of the sheet, to calculate, based on said interval, a distance between the leading edge of said sheet and said leading edge sensing means, and to vary, based on said distance, a rotation start timing of said registration roller pair.

19. A printer comprising:

a sheet feeding device capable of again feeding, when failed to feed a sheet, the sheet by retry control, the sheet feeding device comprising:

a sheet tray configured to be loaded with sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing;

control means for controlling the feed roller and the registration roller pair;

wherein when the retry control is to be executed, the control means is configured to vary a content of control in accordance with information output from the leading edge sensing means, and wherein said control means is configured to count an interval between a time when retry starts and a time when said leading edge sensing means senses the leading edge of the sheet, and to interrupt, if said interval exceeds a reference interval, an operation of said printer by determining that said retry has failed.

20. A printer comprising:

a sheet feeding device capable of again feeding, when failed to feed a sheet, the sheet by retry control, the sheet feeding device comprising:

a sheet tray configured to be loaded with sheets;

a feed roller configured to sequentially feed the sheets from the sheet tray, a top sheet being first;

leading edge sensing means positioned downstream of the feed roller in a direction of sheet feed for sensing a leading edge of the sheet fed from the sheet tray;

a registration roller pair positioned downstream of the leading edge sensing means in the direction of sheet feed and configured to convey the sheet toward an image transfer station at a preselected timing;

control means for controlling the feed roller and the registration roller pair;

wherein when the retry control is to be executed, the control means is configured to vary a content of control in accordance with information output from the leading edge sensing means, and wherein said control means is configured to count either one of a number of rotations of said feed roller and an amount corresponding to said number of rotations and to interrupt, when said number of rotations or said amount exceeds a reference value, an operation of said printer by determining that retry has failed.

* * * * *

UNITED STATES PATENT AND TRADEMARK OFFICE

CERTIFICATE OF CORRECTION

PATENT NO. : 6,832,548 B2
DATED : December 21, 2004
INVENTOR(S) : Hideki Asai et al.

It is certified that error appears in the above-identified patent and that said Letters Patent is hereby corrected as shown below:

Column 4,
Lines 21, 23 and 26, change “damper” to -- clamper --.

Column 13,
Line 9, change “too” to -- top --.

Column 14,
Line 39, change “at” to -- a --.

Signed and Sealed this

Seventeenth Day of May, 2005

JON W. DUDAS
*Director of the United States Patent and Trademark Office*